US006846066B2

(12) United States Patent
Teshikawara et al.

(10) Patent No.: US 6,846,066 B2
(45) Date of Patent: Jan. 25, 2005

(54) RECORDING APPARATUS FOR RECORDING IMAGE BY EXPANDING THE IMAGE IN DOT PATTERN

(75) Inventors: Minoru Teshikawara, Kanagawa (JP); Tetyuya Edamura, Kanagawa (JP); Naoji Otsuka, Kanagawa (JP); Kiichiro Takahashi, Kanagawa (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/692,087

(22) Filed: Oct. 24, 2003

(65) Prior Publication Data

US 2004/0090480 A1 May 13, 2004

(30) Foreign Application Priority Data

Oct. 31, 2002 (JP) ..... 2002-317805

(51) Int. Cl.[7] ..... B41J 2/145; B41J 2/15; B41J 2/205

(52) U.S. Cl. ..... 347/40; 347/15

(58) Field of Search ..... 347/15, 40, 43, 347/14; 358/3.01, 3.06, 3.1, 3.12

(56) References Cited

U.S. PATENT DOCUMENTS 5,648,801 A 7/1997 Beardsley et al.
5,739,828 A 4/1998 Moriyama et al.
5,975,673 A 11/1999 Ohtsuka et al.
6,120,129 A 9/2000 Iwasaki et al.
6,260,938 B1 7/2001 Ohtsuka et al.
6,264,298 B1 * 7/2001 Mantell ..... 347/15
6,312,096 B1 11/2001 Koitabashi et al.
6,328,403 B1 12/2001 Iwasaki et al.
6,328,404 B1 * 12/2001 Fujimori ..... 347/15
6,390,586 B1 5/2002 Takahashi et al.
6,592,203 B1 * 7/2003 Bates et al. ..... 347/40
2002/0105557 A1 8/2002 Teshigawara et al.

FOREIGN PATENT DOCUMENTS

JP 2002-301815 10/2002
WO WO 03/068507 8/2003

* cited by examiner

*Primary Examiner*—Thinh Nguyen
(74) *Attorney, Agent, or Firm*—Fitzpatrick, Cella, Harper & Scinto

(57) ABSTRACT

An ink-jet recording apparatus ejects ink droplets having two sizes, a large size and a small size. The ink-jet recording apparatus records data with a pattern assigned to quantized data. This arrangement reduces density non-uniformity and streaks related to the landing accuracy of ink droplets, the accuracy of sheet conveyance in the recording apparatus, and the accuracy of carriage scanning. Recording is performed with large and small dot-matrix patterns assigned to quantized data on independent planes. When the large dot and the small dot in a pattern are provided to one pixel at the same time, the large dot and the small dot are placed in positions not overlapping in the one pixel.

9 Claims, 10 Drawing Sheets

| | LARGE CYAN | | SMALL CYAN | | |
|---|---|---|---|---|---|
| | No. 1 | No. 2 | No. 1 | No. 2 | |
| LEVEL 0 |  |  |  |  | NUMBER OF RECORDING DOTS = 0 |
| LEVEL 1 |  |  |  |  | NUMBER OF RECORDING DOTS = 1 |
| LEVEL 2 |  |  |  |  | NUMBER OF RECORDING DOTS = 2 |
| LEVEL 3 |  |  |  |  | NUMBER OF RECORDING DOTS = 4 |

RECORDING APPARATUS FOR RECORDING IMAGE BY EXPANDING THE IMAGE IN DOT PATTERN

BACKGROUND OF THE INVENTION

1. Field of the Invention

The present invention relates to an ink-jet recording apparatus, and a recording control method for the ink-jet recording apparatus. More particularly, the present invention relates to a dot-matrix ink-jet recording apparatus that records an image by ejecting ink at a plurality of ejected ink amounts of the same color ink, each value of n-level quantized data (n is equal to or greater than 3) corresponding to a respective ink ejected amount and each value expanded in a matrix of L columns by M rows for each of the plurality of ink amounts of the same color.

2. Description of the Related Art

Many efforts have been made for high-resolution images by using smaller recording liquid droplets in ink-jet recording apparatuses. In one proposed recording apparatus, ink of the same color is ejected at a plurality of amounts to form an image to satisfy both a high-definition requirement and a high-speed recording requirement.

Japanese Patent Laid-Open No. 2002-301815 discloses an ink-jet recording apparatus. In this ink-jet recording apparatus, record data corresponding to a plurality of recording elements different in the size of forming dots is generated, and the generated record data for the plurality of dots different in size is independently converted with respect to one pixel. The conversion process here refers to a relatively low resolution and multi-level quantization process that is performed by a host apparatus. Image data subjected to the conversion process is transferred to the recording apparatus. The recording apparatus then converts the received low-resolution and multi-level quantized data to a dot pattern of a predetermined matrix. The recording apparatus performs a so-called dot-matrix recording by recording the data in the dot pattern.

Several techniques have been proposed in connection with the recording method using dot matrix. In one technique, a plurality of dot matrices different in dot pattern are prepared beforehand, and a dot matrix is selected from among the plurality of dot matrices according to a random number having a predetermined number of bits, and is then assigned to the record data. In another technique, the presence or absence of data in a raster is identified, and the dot patterns are successively switched.

It is found that the dot patterns assigned to each of the plurality of dots different in size cause the following problem depending on the layout of the dot patterns.

An error in the landing of ink droplets, the sheet conveyance in the recording apparatus, and the scanning of a carriage may cause periodic density non-uniformities and streaks on an actual image in which the same tonal gradation continuously extends.

The periodic non-uniformities and streaks are closely related to a dot coverage ratio per unit pixel, namely, a so-called area factor per unit pixel. If dots different in size are placed in the same pixel in an overlapping manner with an image output in an intermediate gradation region, the area factor gets smaller than in the case where the dots are separately placed, and the density non-uniformities and streaks become pronounced.

If horizontally aligned recording heads for projecting ink droplets of a plurality of colors are used, dots different in size or different in color may be placed in an overlapping position along the same path. A recording medium fails to fully absorb ink in a localized area. The dot is deformed in shape, thereby becoming a noise-like image not preferable in the image formation.

SUMMARY OF THE INVENTION

Accordingly it is an object of the present invention to provide an ink-jet recording apparatus that records a high-definition image free from density non-uniformities, streaks, and deformation of a dot shape when a plurality of dots different in size are used to record the image.

An ink-jet recording apparatus of the present invention records an image on a recording medium using a recording head having a plurality of recording elements that result in dots different in size. The ink-jet recording apparatus quantizes the record data in n level-quantization (n is equal to or larger than 3) at a predetermined resolution so that the sizes of the dots formed by the recording head correspond to the plurality of recording elements, assigns the quantized input image data to a dot matrix, and ejects ink in a dot pattern of the assigned dot matrix. The ink-jet recording apparatus includes a matrix storage unit that stores beforehand a plurality of dot matrices different in dot pattern in response to input image data at the same signal level, a dot pattern setting unit that independently sets the dot pattern stored in the dot matrix storage unit to each of the plurality of recording elements that form dots different in size, and a dot matrix assignment unit that selects and assigns a dot matrix corresponding to a signal level of the input image data from the plurality of dot matrices stored in the matrix storage unit, and expands the dot pattern of the assigned dot matrix in a buffer.

The input image data may be color image data, and the dot pattern setting unit sets the dot matrix independently on a color by color basis.

Further objects, features and advantages of the present invention will become apparent from the following description of the preferred embodiments with reference to the attached drawings.

DESCRIPTION OF THE PREFERRED EMBODIMENTS

The present invention will now be discussed with reference to the drawings.

An ink-jet recording apparatus of the present invention records an image on a recording medium using a recording head having a plurality of recording elements that result in dots different in size. The ink-jet recording apparatus quantizes the record data in an n level quantization (n is equal to or larger than 3) at a predetermined resolution so that the sizes of the dots formed by the recording head correspond to the plurality of recording elements. When the quantized data is assigned to a dot matrix of L columns and M rows, one dot matrix pattern is selected from a plurality of dot matrices having different patterns and is assigned to the quantized data at the same signal level, namely, the image data at the same level subsequent to the quantization. The dot patterns of the dot matrices corresponding to the record data of a plurality of recording elements presenting dots different in size are arranged so that large and small dots are separately located in a manner such that the dots different in size in low and intermediate level regions are not overlapped on each other.

The use of the assigned dot pattern for image recording controls density non-uniformities and streaks generated in an intermediate gradation region, in particular, in a recorded image, subject to projection performance and mechanical accuracy of the recording head of the ink-jet recording apparatus having a relatively high resolution.

When the horizontally aligned recording heads are used, the dots different in size in the low to intermediate gradation regions are not formed in an overlapping position along the same path. This arrangement controls the deformation of the dot attributed to localized ink run on a recording medium, thereby reducing noisiness in the recorded image.

In the dot matrix formation, dot patterns are independently set for yellow (Y), magenta (M), and cyan (C). The dots are arranged in the dot matrix pattern. In the magenta and cyan dot matrix patterns, having a low lightness and a high visibility, dots of the patterns used in the low to intermediate gradation region are separately located. In this arrangement, noisiness is reduced in a secondary color (blue) having a low lightness and a high visibility.

General Structure of Ink-jet Recording Apparatus

The general structure of the ink-jet recording apparatus implementing the present invention will now be discussed.

(1) Ink-jet Color Recording Apparatus

Figure 9:
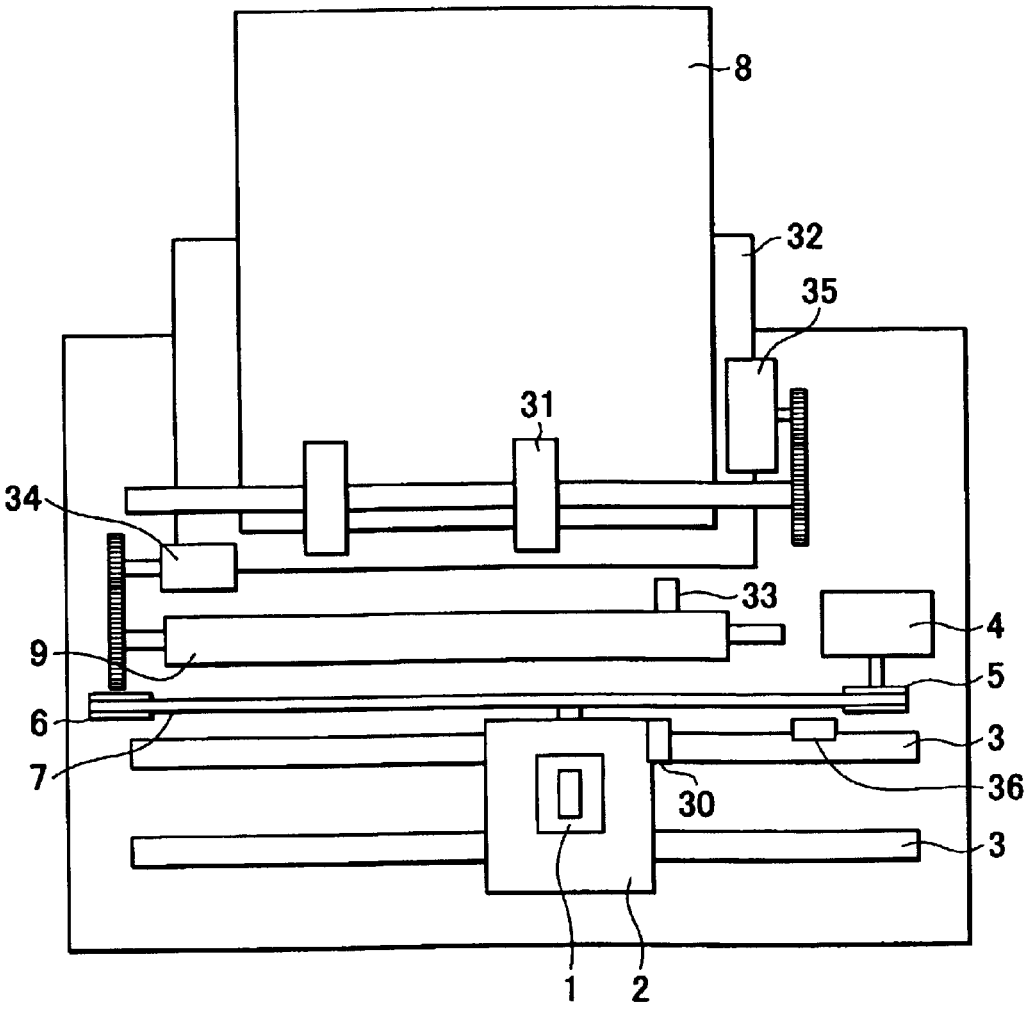
FIG. 9 illustrates a major portion of an ink-jet recording apparatus implementing the present invention.

FIG. 9 illustrates a major portion of the ink-jet recording apparatus. The ink-jet printing apparatus (the recording apparatus) employs a head cartridge as recording means.

As shown in FIG. 9, a head cartridge 1 is detachably mounted on a carriage 2. The head cartridge 1 includes a print head and an ink tank. The head has a connector (not shown) to exchange signals for driving the print head. The head cartridge 1 is detachably mounted on and aligned with the carriage 2. The carriage 2 has a connector holder (for electrical connection) that holds the connector through which a drive signal, etc., is transferred to the head cartridge 1.

The carriage 2 is supported by guide shafts 3 in a manner such that the carriage 2 is reciprocated along the guide shafts 3. The guide shafts 3 extend in a main scan direction of the head cartridge 1 and are secured to the body of the recording apparatus. The carriage 2 is driven by a driving mechanism including a motor pulley 5, a driven pulley 6, and a timing belt 7. The driving mechanism is driven by a main scan motor 4. The carriage 2 is thus controlled in position and movement by the main scan motor 4. A home position sensor 30 is disposed on the carriage 2. The position of the carriage 2 is thus known at the moment the home position sensor 30 of the carriage 2 passes by a blocking plate 36.

Printing media 8, such as a printing sheet or plastic thin film, are detached and fed from an automatic sheet feeder (ASF) 32 one by one when a sheet feeder motor 35 rotates pickup rollers 31 through gears. With conveyance rollers 9 rotating, the printing medium 8 is conveyed in a sub scan direction and passes by a printing position facing an ejection port surface of the head cartridge 1. The conveyance rollers 9 are driven through gears, which are driven by an LF motor 34 through gears. The determination of whether or not a sheet is fed and the detection of a leading edge of the sheet are performed at the moment the printing medium 8 passes by a paper end sensor 33. The paper end sensor 33 is also used to locate the trailing edge of the printing medium 8 and to detect a current recording position ahead of the trailing edge.

The printing medium 8 is supported from below by a platen (not shown) to form a flat printing surface in a printing position. The head cartridge 1 mounted on the carriage 2 has the ejection port surface projected downward and is supported between two pairs of conveyance rollers so that the ejection port surface is parallel to the printing medium 8.

The head cartridge 1 is an ink-jet head cartridge that ejects ink using thermal energy, and has an electrical to thermal energy converting unit for generating thermal energy. Using pressure of a bubble caused by film boiling resulting from the thermal energy, a print head of the head cartridge 1 ejects ink through an ejection port thereof. Any other ink ejection method is acceptable. For example, a piezoelectric element may be used to eject ink.

Figure 10:
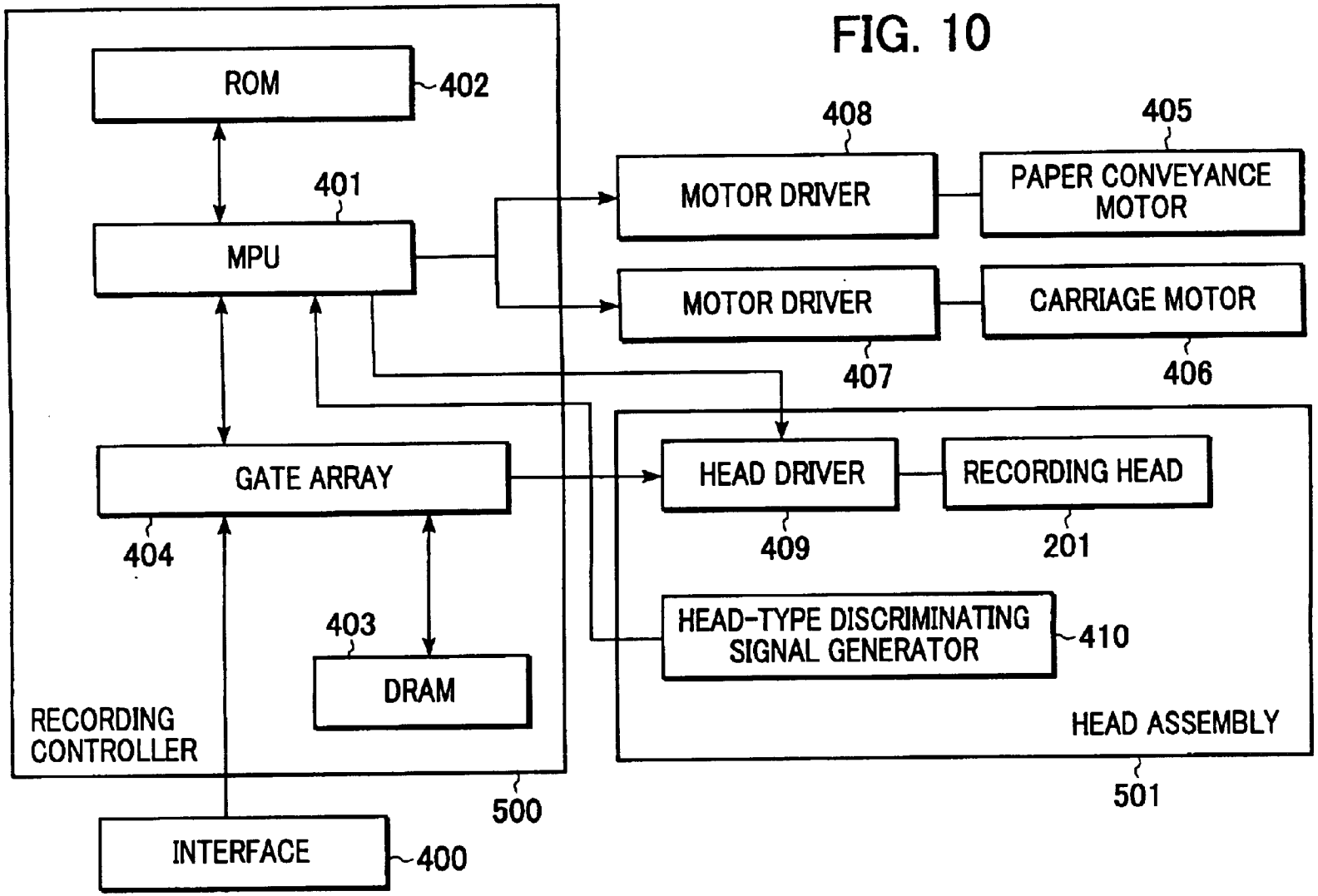
FIG. 10 is a block diagram illustrating the controller of the recording apparatus.

A controller for executing recording control of the recording apparatus will now be discussed with reference to FIG. 10.

As shown, the controller includes an interface 400 for inputting a record signal, an MPU 401, a program ROM 402 for storing a control program to be executed by the MPU 401, a dynamic RAM (DRAM) 403 for storing a variety of data including the record signal, record data fed to the head, the number of print dots, and the number of replacements of the recording head. A gate array 404 controls the supply of the record data to a recording head 410, and also controls the transfer of data to the interface 400, the MPU 401, and the DRAM 403. A carriage motor 406 moves the recording head, and a conveyance motor 405 conveys a recording sheet. Motor drivers 408 and 407 drive the carriage motor 405 and the conveyance motor 406, respectively. A head driver 409 drives the recording head 410.

(2) Recording Head

The recording head 1 will now be discussed with reference to FIG. 11.

Figure 11:
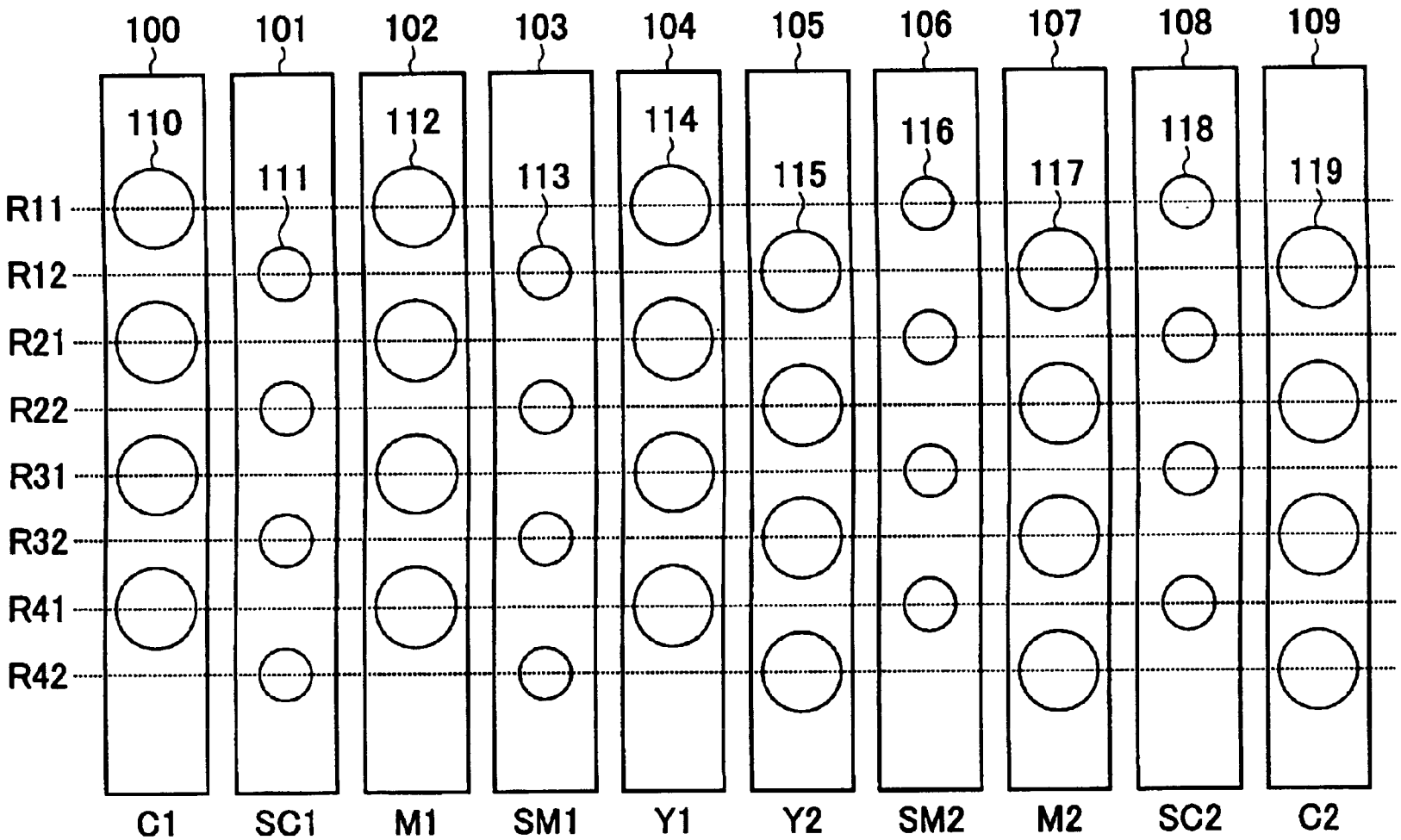
FIG. 11 diagrammatically illustrates a major portion of a recording head used in the ink-jet recording apparatus implementing the present invention.

FIG. 11 diagrammatically illustrates a first structure of a major portion of the recording head 1 of the head cartridge 2. As shown, a first recording head 100 for a large cyan dot is referred to as 100C1. A first recording head 101 for a small cyan dot is referred to as 101SC1. A first recording head 102 for a large magenta dot is referred to as 102M1. A first recording head 103 for a small magenta dot is referred to as 103SM1. A first recording head 104 for a large yellow dot is referred to as 104Y1. A second recording head 105 for a large yellow droplet is referred to as 105Y2. A second recording head 106 for a small magenta dot is referred to as 106SM2. A second recording head 107 for a large magenta dot is referred to as 107M2. A second recording head 108 for a small cyan dot is referred to as 108SC2. A second recording head 109 for a large cyan dot is referred to as 109C2. A pair of recording heads forming the same color pixel are shifted from each other by half the nozzle pitch in the direction of sub scan. This shifting is intended to reduce dot overlapping to achieve the maximum density and to increase the dot coverage ratio. A black (Bk) recording head may be additionally used.

The above recording heads are grouped as a head cartridge 1. In the head cartridge 1, each recording head contains a plurality of ejection nozzles. For example, the recording head 100C1 contains cyan ink ejecting nozzles 110, and the recording head 101SC1 contains small cyan ejecting nozzles 111.

The nozzle group in each recording head is arranged in a line generally perpendicular to the main scan direction. Occasionally, the nozzle group may be arranged in a line slightly slanted relative to the main scan direction, rather than being perpendicular to the main scan direction, in relation to an ink ejection timing. Alternatively, the nozzle group may be aligned in parallel with the main scan direction. Specifically, the recording heads 100C1, 101SC1, 102M1, 103SM1, 104Y1, 105Y2, 106SM2, 107M2, 108SC2, and 109C2 are arranged in parallel with the main First Preferred Embodiment scan direction.

In a first preferred embodiment, an ink-jet recording apparatus of the present invention records an image on a recording medium using a recording head having a plurality of recording elements that result in dots different in size. The ink-jet recording apparatus quantizes the record data in n level quantization (n is equal to or larger than 3) at a predetermined resolution so that the sizes of the dots formed by the recording head correspond to the plurality of recording elements. When the quantized data is assigned to a dot matrix of L columns and M rows, one dot matrix pattern is selected from a plurality of dot matrices having different patterns and is assigned to the quantized data at the same signal level, namely, the image data at the same level subsequent to the quantization. The dot matrices of L columns by M rows are stored beforehand with the record data, of the plurality of recording elements resulting in dots different in size, associated with the dot matrices of L columns by M rows.

The ink-jet recording apparatus of the first preferred embodiment has the above-referenced structure of the recording apparatus.

Figure 1:
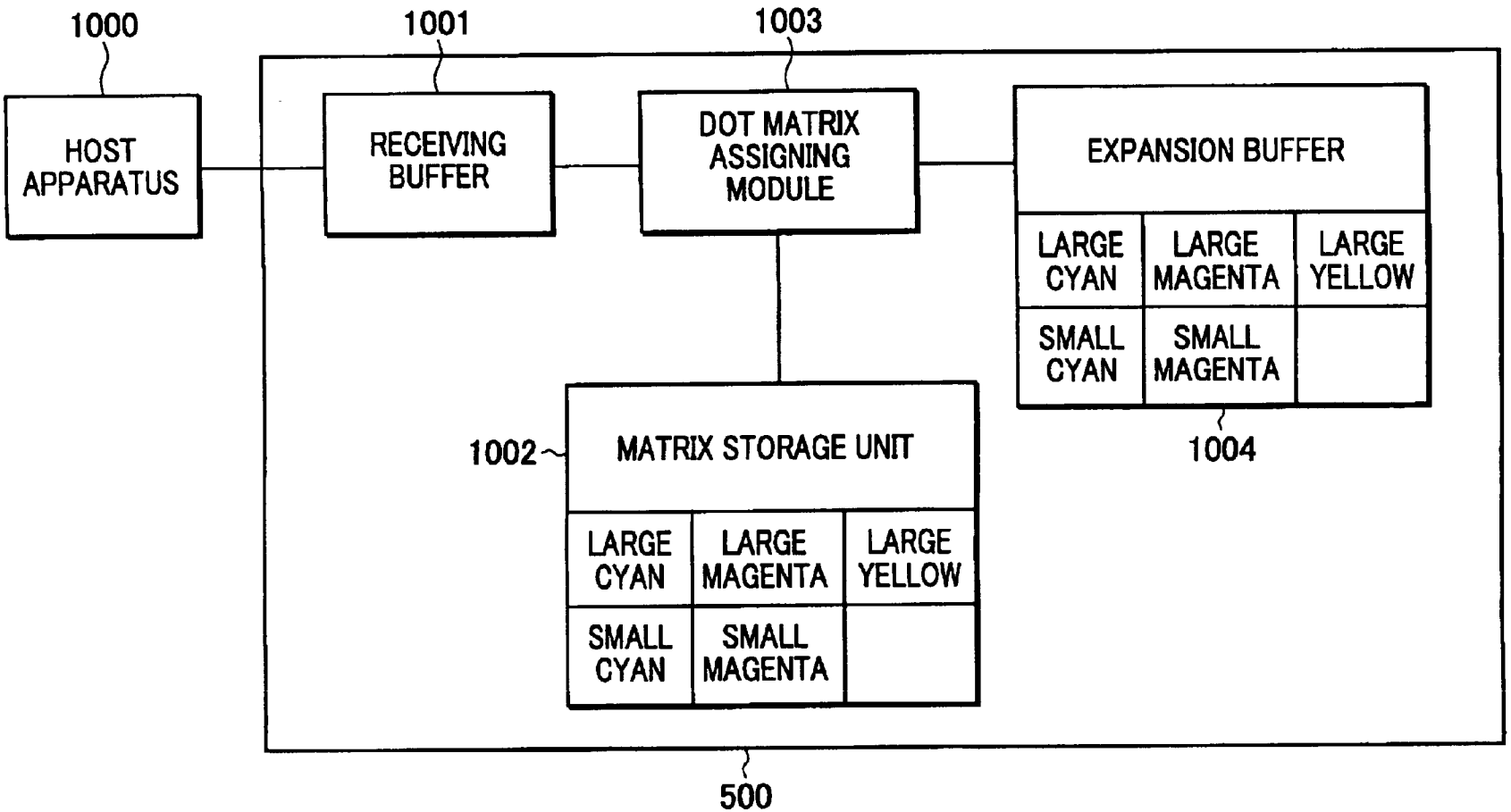
FIG. 1 is a block diagram of a recording controller of an ink-jet recording apparatus implementing the present invention.

FIG. 1 is a block diagram illustrating a recording controller 500 of the ink-jet recording apparatus in accordance with the first preferred embodiment of the present invention.

As shown, the recording controller 500 of the ink-jet recording apparatus includes a receiving buffer 1001 for receiving quantized data from a host apparatus 1000, a matrix storage unit 1002 for storing a matrix pattern, a dot matrix assigning module 1003 for assigning a dot matrix to the quantized data in the receiving buffer 1001 using the matrix pattern, and an expansion buffer (print buffer) 1004 for expanding the quantized data (data corresponding to record data that is assigned to the dot matrix subsequent to the quantization) which is expanded using the dot matrix assigned by the dot matrix assigning module 1003. The recording controller 500 contains memories, such as a ROM and a DRAM, and an MPU performing a process. In comparison with the structure shown in FIG. 10, the dot matrix assigning module 1003 corresponds to a software module stored beforehand in the program ROM 402 and executed by the MPU 401. The receiving buffer 1001, the matrix storage unit 1002, and the expansion buffer 1004 correspond to the DRAM 403. The quantized data is stored at a predetermined address in the DRAM 403.

Figure 3:
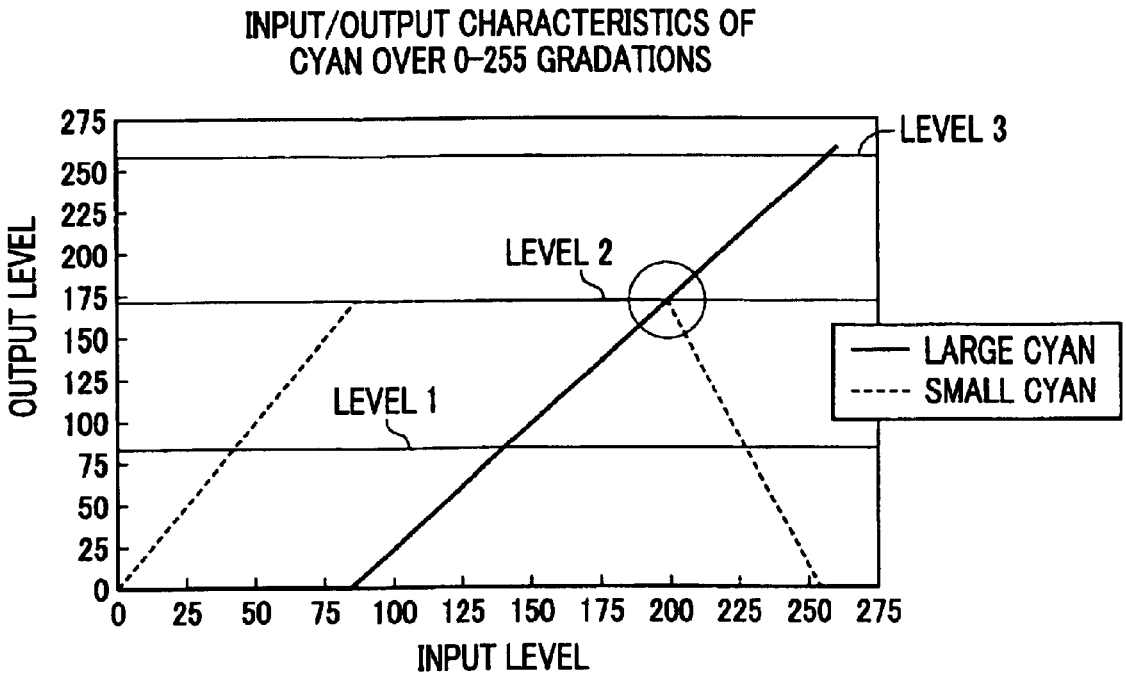
FIG. 3 illustrates an image signal value subsequent to and prior to a color conversion in accordance with the first preferred embodiment of the present invention.

As illustrated in FIG. 3, the matrix storage unit 1002 stores beforehand the pattern of the dot matrix that can be taken by the quantized data at each of signal levels, level 0 to level 3, for each of the dots different in size. The pattern is numbered before being stored.

One of a plurality of dot matrix patterns stored in the matrix storage unit 1002 is selected, and the selected pattern is then expanded onto the expansion buffer 1004. This process will be discussed with reference to the drawings.

In the first preferred embodiment, image data, which is quantized to four levels (2 bits) at a resolution of 600 columns by 600 rows DPI by the host apparatus 1000, is expanded to print data at a resolution of 1200 columns by 1200 rows DPI (2×2 dot matrix) in the ink-jet recording apparatus. The print data expanded according to the unit of dot refers to data stored in the expansion buffer 1004.

Figure 2:
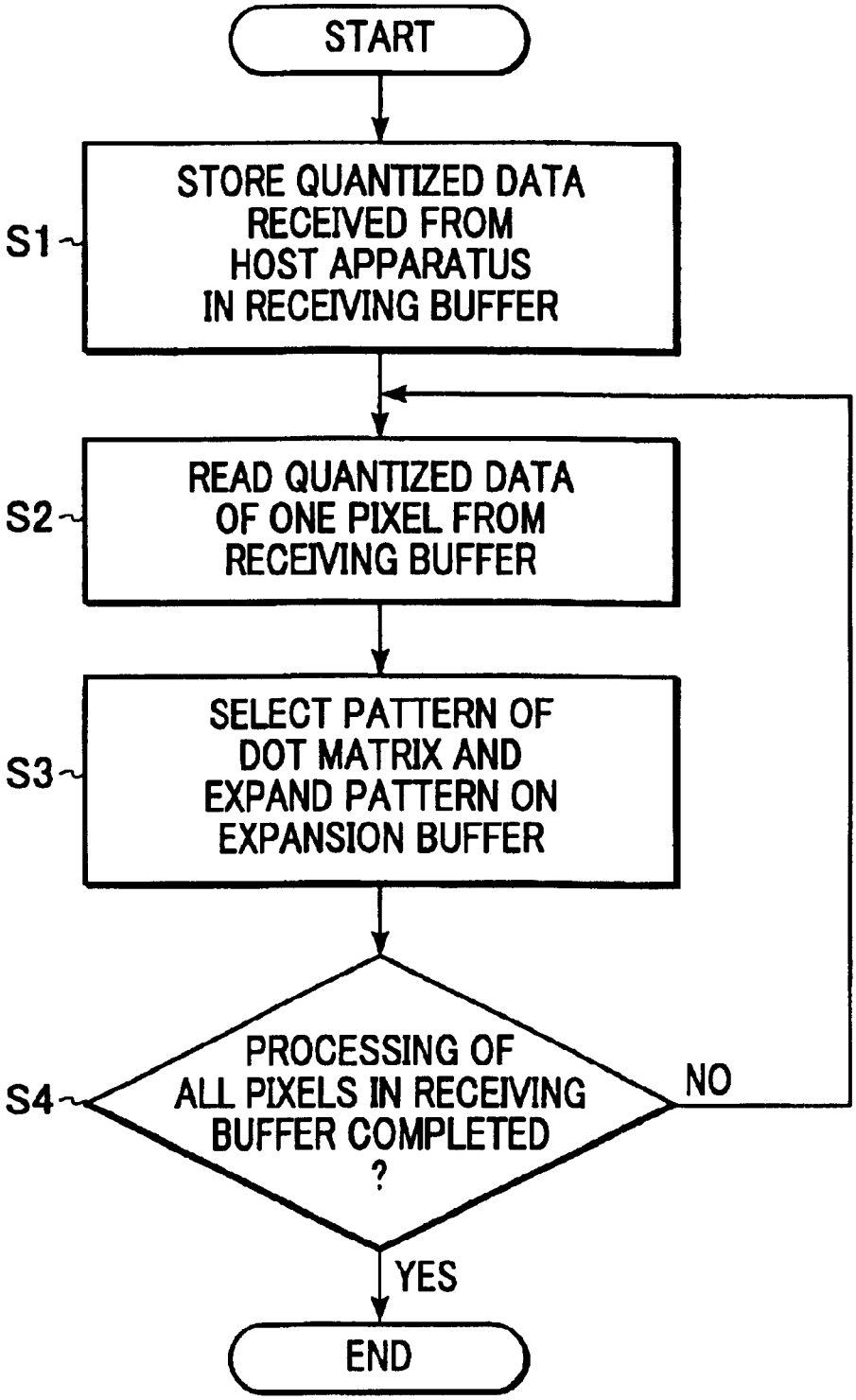
FIG. 2 is a flow diagram illustrating a data expansion process in accordance with a first preferred embodiment of the present invention.

FIG. 2 is a flow diagram illustrating a data expansion process performed by the dot matrix assigning module 1003 in accordance with the first preferred embodiment of the present invention.

As shown, in step S1, the recording controller 500 receives 2 bit data (4 levels corresponding to 0 through 3) transferred from the host apparatus 1000. The received data is stored in the receiving buffer 1001. In step S2, 2 bit quantized data for one pixel is read. In the first preferred embodiment, the number of patterns of quantized data at the same signal level is two. In step S3, one of the dot matrix patterns corresponding to the quantized data for the one pixel read in step S2 is selected. The dot matrix pattern is expanded onto the expansion buffer 1004. When the dot matrix pattern is selected, the two patterns at the same level are alternately assigned referencing the presence or absence of data in the raster. It is then determined in step S4 whether the image data of all pixels stored in the receiving buffer 1001 in step S1 is expanded onto the expansion buffer 1004. If pixels remain unexpanded (no answer to the determination in step S4), the algorithm loops to step S2. If the answer to the determination in step S4 is yes, the data expansion process ends.

FIG. 3 plots image signal values prior to and subsequent to a color conversion process performed in the host apparatus in order that the recording apparatus records data on the recording medium using a recording head having a plurality of recording elements resulting in dots different in size. Input signals for cyan ink ejection ranging from zero to 255 are plotted along the abscissa and output signal values subsequent to the conversion process are plotted along the ordinate. The graph in FIG. 3 presents a profile of a small cyan (small ejected amount of cyan ink) and a large cyan (large ejected amount of cyan ink). In the first preferred embodiment, to convert the output into four levels, the image output values 0/255, 85/255, 170/255, and 255/255 (each representing the output value with respect to the image input value) are referred to as level 0, level 1, level 2, and level 3. The dot matrix, from a plurality of dot patterns, corresponding to the level is assigned. More specifically, level 0 through level 3 are set to the outputs of a large dot and a small dot responsive to the input value in a particular color (cyan in FIG. 3) to assign the dot matrix to the level of the output value. In the quantization process to convert multi-value data of 255 to 4 level data, the known error distribution method may be used. Accounting for multi values (0 through 255) of data of surrounding pixels, the image data is quantized into 4 values. To avoid ejecting small dots at a high density in FIG. 3, the upper limit of the level of the small dot is 2, and the input values 0 through 255 are converted into outputs of the large dot and the small dot.

To assign the dot matrix, one dot matrix may be selected from among a plurality of dot matrices based on a random number having a predetermined bit number, or the dot patterns may be successively selectively switched by detecting the presence or absence of data in the raster.

Figure 4:
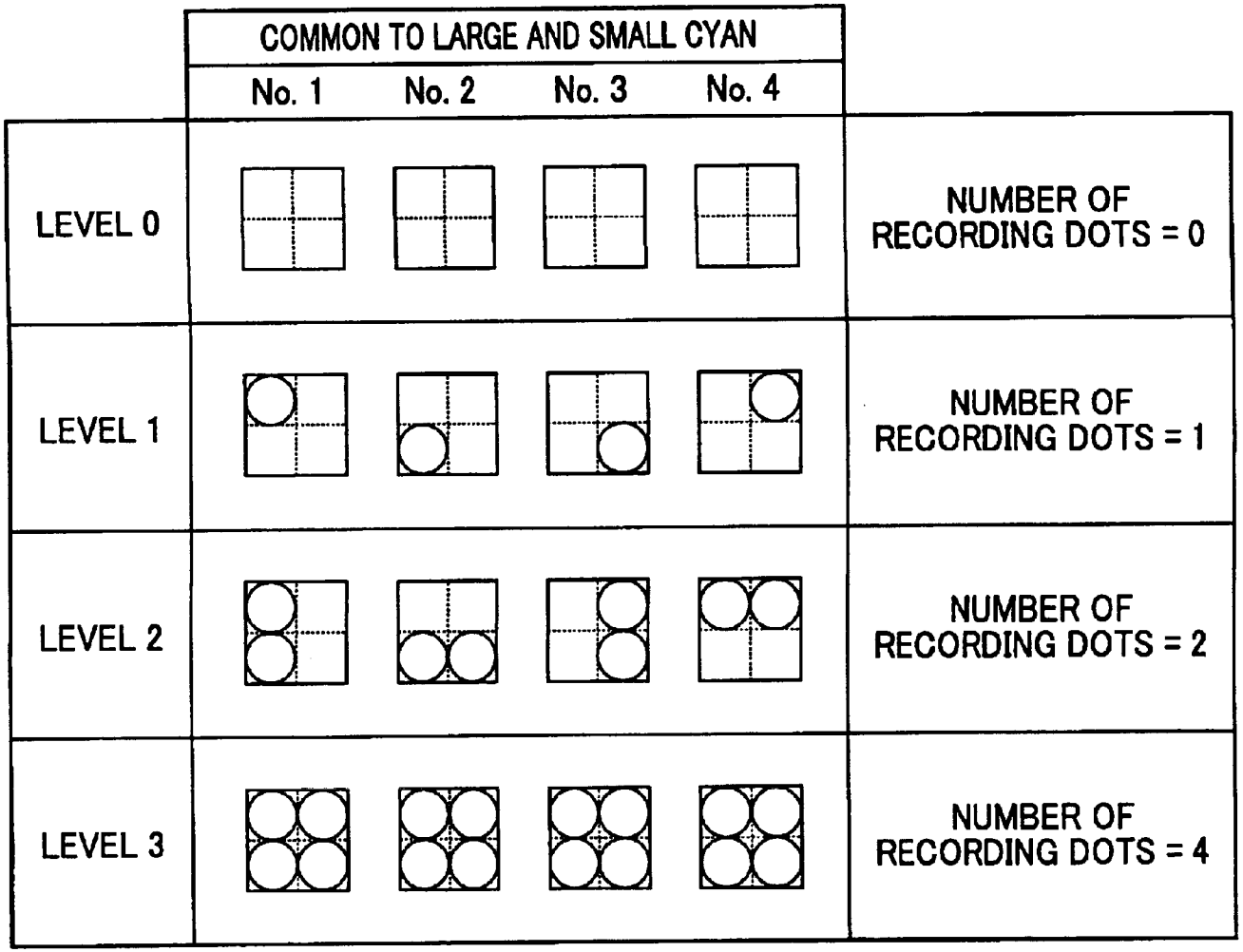
FIG. 4 illustrates a pattern of a dot matrix at each level for use in the recording apparatus.

FIG. 4 illustrates a known dot matrix pattern, which is commonly used. As shown, numbers 1 through 4 are assigned to dot matrix patterns the quantized data can take at each of the level 0 through the level 3. These dot matrix patterns are stored beforehand in the ROM, for example. For convenience of explanation, a maximum of four patterns are stored for the quantized data at a given level. The present invention is not limited to the four patterns. The number of patterns is preferably optimized taking into consideration the structure of the recording apparatus. If the number of different dot matrix patterns is not more than four, the same pattern may be used.

Figure 5:
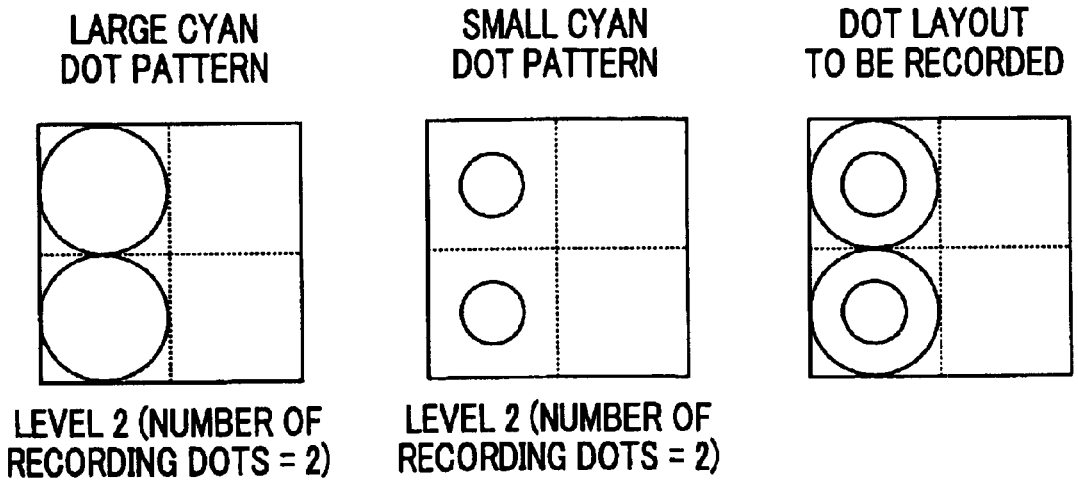
FIG. 5 illustrates recording positions of large dots and small dots in the matrix.

As shown in FIG. 3, the small cyan dots and the large cyan dots coexist to form an image in an intermediate input gradation region from 200 to 255. An image, in which the same gradation level extends, is formed of the dot matrix of the large cyan dots at level 2 and the dot matrix of the small cyan dots at level 2 if the dot matrices shown in FIG. 4 are used. Depending on a combination of the patterns, the large cyan dots and the small cyan dots overlap each other as shown in FIG. 5C. If an image is formed in such a pattern combination, the area factor thereof becomes smaller than in the combination where the large cyan dot and the small cyan dot are placed at different positions, namely, spaced apart. Density non-uniformities and streaks may be generated in a recorded image depending on the projection performance and mechanical precision of the recording head.

Figure 6:
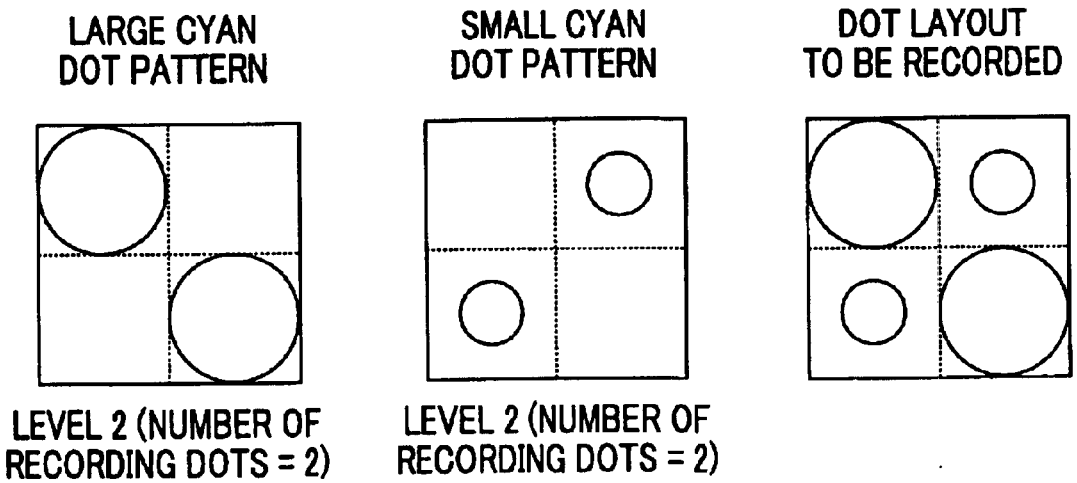
( PRIOR ART ) FIG. 6
FIG. 6 illustrates recording positions of large dots and small dots in the matrix.

In accordance with embodiments of the present invention, the dot pattern of the small cyan dots and the dot pattern of the large cyan dots are arranged in complementary positions as shown in FIGS. 6A–6C. The large dots and the small dots are thus recorded in different positions. In such an arrangement, the area factor is increased, and image recording is performed in a dot layout that is preferred in view of image quality. The dot matrix pattern of the present invention controls more the density non-uniformities and streaks than the known pattern shown in FIG. 4. High image quality recording is thus achieved.

The large cyan dot and the small cyan dot may be presented along the same path in principle using a recording cartridge having horizontally aligned heads, namely, a plurality of recording heads aligned in the main scan direction thereof. If the large cyan dot and the small cyan do not overlap in position, a large amount of ink is localized, running on a recording sheet. The dot shape is deformed, causing the resulting image to look like noise to the eyes of the user.

To prevent a localized ink run, the dot matrix is changed according to the size of the dot and the dots different in size are spaced apart from each other. The feature of the first preferred embodiment of the present invention is that the dot matrix is changed for different dot size and that the dot patterns are independently set.

Figure 7:
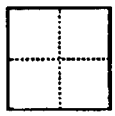
FIG. 7 illustrates dot patterns in which a dot matrix is arranged on a per dot size basis.
Figure 7:
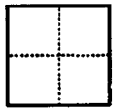
Figure 7:
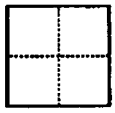
Figure 7:
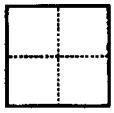
Figure 7:
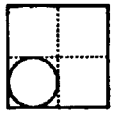
Figure 7:
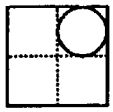
Figure 7:
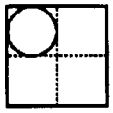
Figure 7:
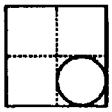
Figure 7:
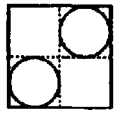
Figure 7:
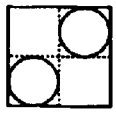
Figure 7:
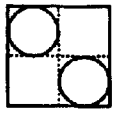
Figure 7:
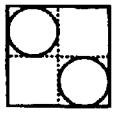
Figure 7:
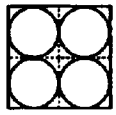
Figure 7:
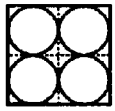
Figure 7:
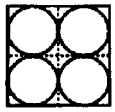
Figure 7:
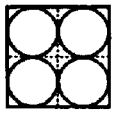

FIG. 7 illustrates an example of dot patterns in which the dot matrix is arranged according to size of the dot. Numbers 1 and 2 are assigned to the patterns the quantized data can take at each of the signal levels 0 through 3 before the quantized data is stored. A maximum of two patterns are assigned to the quantized data at a given level, and the patterns of dots different in size complement each other. In low to intermediate gradation regions wherein the dots different in size coexist, in other words, dot matrices at level 1 and level 2 are used, the dots different in size are always separated.

The dot patterns illustrated in FIG. 7 have the feature that, at each of n levels (n is 0, 1, 2, or 3) except the highest level, the dots in the large dot pattern and the dots in the small dot pattern at least at the same level are not placed at the same recording positions. In such an arrangement, the problem that has already discussed with reference to FIGS. 5A–5C is avoided. Preferably, the dot recording positions are different between the large dot pattern and the small dot pattern at least at the same level. In this arrangement, even if the pattern of large dots and the pattern of small dots at the same level are overlapped on each other, no dots overlap each other on the recording medium. The area factor is heightened, and the conventional problem is thus controlled.

In the patterns illustrated in FIG. 7, at each of the levels except the highest level, the large dots and the small dots do not overlap each other even if the large dot pattern and the small dot pattern are recorded on the same pixel. For example, if two large dot patterns at level 1 and two small dot patterns at level 2 are recorded in any combination, the dot pattern is formed so that the large dot and the small dot do not overlap in a resulting pattern. In this arrangement, the large dots and the small dots are not overlapped on each other and separately recorded in a plurality of dot positions in the same pixel from low to intermediate gradation regions. The recording apparatus thus overcomes the drawback of the conventional art, and records a high-quality image.

At level 3, the dot patterns of the large cyan dots and the small cyan dots are the same, and the dots different in size are overlapped with each other. The level 3 signals provide a high recording density, presenting a satisfactory area factor. There is no possibility that the density non-uniformities and streaks occur in the recorded image. In the first preferred embodiment, the small dots are not used at level 3 because the image recording is performed in accordance with the profile illustrated in FIG. 3.

As shown in FIG. 11, the recording head with the recording elements symmetrically arranged in color is employed, whether to record data on a pixel in the raster is preferably determined, one of number 1 pattern and number 2 pattern shown in FIG. 7 is successively selected, and the selected pattern is assigned to each pixel. In this arrangement, the frequency of use of each recording element in the recording head is distributed.

In the first preferred embodiment, the recording head includes, at least, the first recording element and the second recording element corresponding to the large dot and the small dot, respectively. The use of the dot pattern corresponding to the first recording element and the dot pattern corresponding to the second recording element prevents the dot recorded by the first recording element and the dot recorded by the second recording element from overlapping each other. This arrangement overcomes the drawback of the conventional art.

Second Preferred Embodiment

A second preferred embodiment of the present invention will now be discussed with reference to the drawings.

The recording apparatus of the second preferred embodiment is also constructed as already discussed with reference to FIGS. 9 and 10, and the recording head of the recording apparatus is also constructed as already discussed with reference to FIG. 11. The detail of the structure of the recording apparatus is not discussed again here.

In the second preferred embodiment, the dot matrix patterns are selected on a color by color basis (Y, M, and C). The dot matrix pattern is set and assigned to the recording image of each color. This is different from the first preferred embodiment of the present invention. From among a plurality of colors (Y, M, and C), the dots in the dot patterns of magenta (M) and cyan (C), having a low lightness and a high visibility, used in low to intermediate gradation regions are separately placed. Noisy image is thus reduced in a secondary color (blue) having a low lightness and a high visibility. Ink-jet printers typically use black ink, but black ink is separately used in many cases. In the second preferred embodiment, the colors, which are particularly separated from among the colors of Y, M, and C except Bk, are two colors, namely, magenta (M) and cyan (C).

Figure 8:
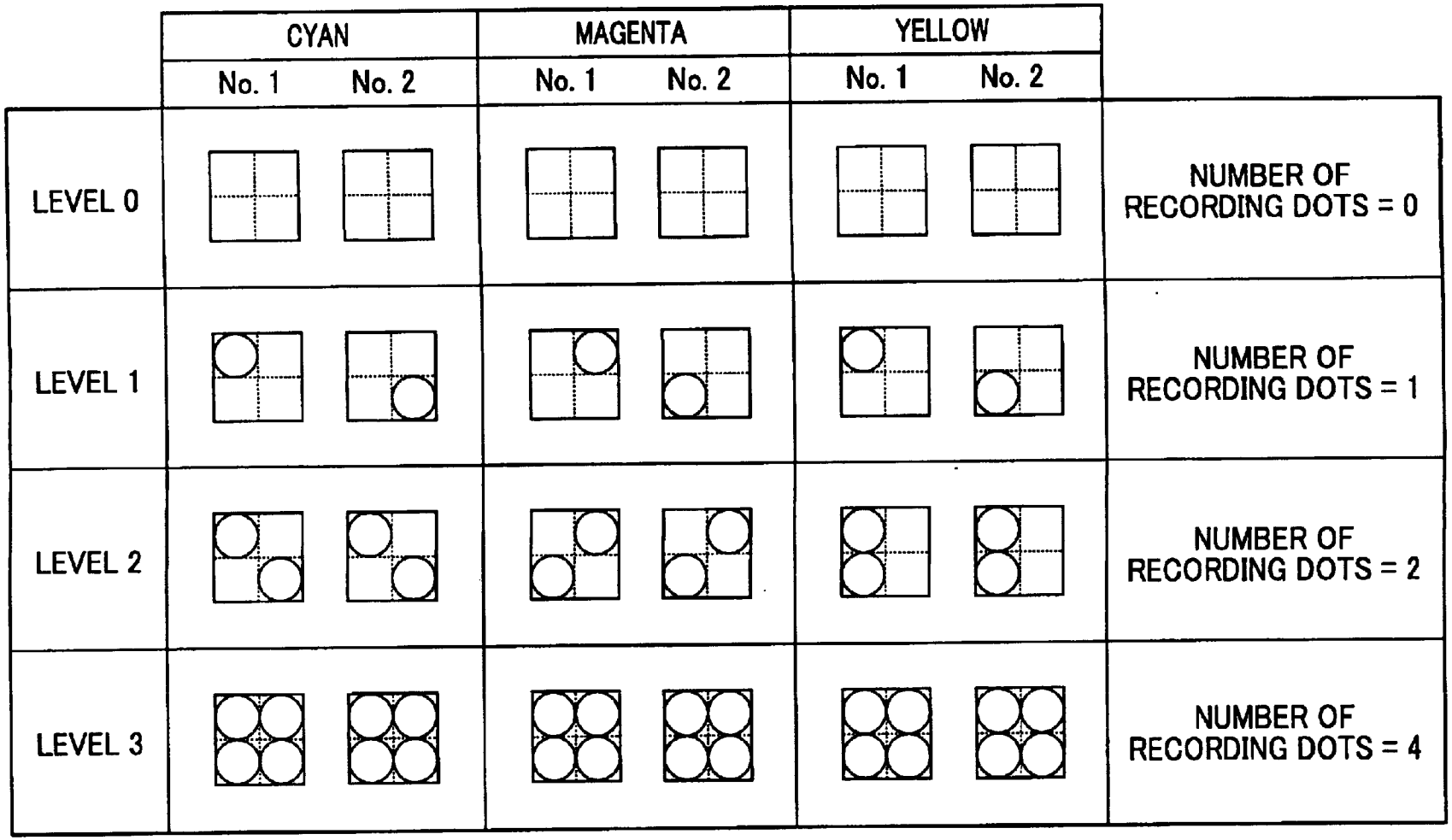
FIG. 8 illustrates a dot pattern in which a dot matrix is assigned to each color.

FIG. 8 illustrates an example of dot patterns in the second preferred embodiment, in which cyan (C), magenta (M), and yellow (Y) dot matrices are independently assigned.

As already discussed, the cyan and magenta patterns, having a low lightness, are arranged in mutually non-overlapping positions. A yellow pattern naturally overlaps the other colors, and is arranged to overlap equally cyan and magenta patterns.

The data expansion process performed by the dot matrix assigning module 1003 is substantially identical to the data expansion process in the first preferred embodiment. The main difference between the first and second preferred embodiments is that the data expansion process is performed on yellow, magenta, and cyan on a color by color basis.

As discussed above, the dot matrix patterns are independently set on the colors of yellow, magenta, and cyan on a color by color basis. A dot pattern is selected from the plurality of dot patterns at the same level. The dots of the selected pattern are expanded in the expansion buffer 1004. In this way, the dots in the pattern of the recording image used in low to intermediate gradation regions are separately arranged. Noisiness of image in a secondary color (blue) having a low lightness and a high visibility is thus reduced.

In the second preferred embodiment, the recording head includes, at least, the first recording element and the second recording element corresponding to cyan and magenta. The use of the dot pattern corresponding to the first recording element and the dot pattern corresponding to the second recording element prevents the dot recorded by the first recording element and the dot recorded by the second recording element from overlapping each other. This arrangement overcomes the drawback of the conventional art.

In addition to the patterns discussed in connection with the second preferred embodiment with reference to FIG. 8, the patterns of small dots of each color may be arranged as illustrated in FIG. 7. The large dot and the small dot of the same color are separately recorded, but the large dot and the small dot different in color are overlapped with each other in recording. This arrangement overcomes the problem that the density non-uniformities and streaks appear in low to intermediate gradation regions in a particular color, and reduces noisiness in the secondary color in which substantially equal amounts of cyan and magenta inks are used. The present invention thus achieves improved image quality.

In accordance with the present invention, the recording head having the first and second recording elements corresponding to, at least, the large dot and the small dot is used, or the recording head having the first and second recording elements corresponding to different colors is used. The record data of n levels (n is an integer equal to or larger than 3) is expanded in a dot pattern at each of the n levels. By setting the dot pattern corresponding to the first and second recording elements, the recorded image becomes a high quality image free from the density non-uniformities and streaks.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for recording an image onto a recording medium using recording means having, at least, a first recording element and a second recording element, the recording apparatus comprising:

storage means for storing patterns, corresponding to each of n levels of record data (n is an integer equal to or larger than 3), and representing the presence or absence of a dot at each of a plurality of recording dot positions, the patterns stored in the storage means corresponding to the first and second recording elements;

a buffer for storing data to be recorded by the first and second recording elements;

means for acquiring, from the storage means, the patterns of the n levels of record data corresponding to each of the first and second recording elements, and for expanding the patterns in the buffer; and recording control means for controlling the first and second recording elements to record the data expanded in the buffer, wherein a dot to be recorded in the pattern corresponding to the first recording element and a dot to be recorded in the pattern corresponding to the second recording element, at the same level, do not coincide with each other in position except in the pattern at the highest level n.

2. A recording apparatus according to claim 1, wherein the first and second recording elements are different from each other in the size of dots for recording.

3. A recording apparatus according to claim 1, wherein a dot to be recorded in the pattern of the first recording element and a dot to be recorded in the pattern of the second recording element, at the same level, do not overlap each other in position except in the pattern at the highest level n.

4. A recording apparatus according to claim 1, wherein dots to be recorded in a plurality of patterns corresponding to the first recording element at each of the n levels and dots to be recorded in a plurality of patterns corresponding to the second recording element at each of the levels do not overlap each other in position except in the pattern at the highest level n.

5. A recording apparatus according to claim 1, wherein the first recording element and the second recording element are different in recording color.

6. A recording apparatus according to claim 5, wherein at least yellow, magenta, and cyan inks are ejected for recording, and wherein the first recording element and the second recording element eject the cyan ink and the magenta ink, respectively.

7. A recording apparatus according to claim 5, further comprising a plurality of recording elements that record dots different in size at least in predetermined colors of a plurality of colors, and wherein the patterns respectively used for the plurality of recording elements that record dots different in size do not coincide with each other in the recording dot positions except in the pattern at the highest level n.

8. A recording apparatus according to claim 7, wherein the predetermined colors are magenta and cyan.

9. A control method for a recording apparatus that records an image on a recording medium using recording means including, at least, a first recording element and a second recording element, the control method comprising the steps of:

acquiring patterns, stored in storage means, representing the presence or absence of a dot at each of plurality of recording dot positions in response to record data at n levels (n is an integer equal to or larger than 3) for each of the first recording element and the second recording element;

expanding the patterns corresponding to the first recording element and the second recording element in a buffer; and recording the image using the recording means in response to data of respective dots expanded in the buffer, wherein the storage means stores the patterns at each of n levels for each of the first recording element and the second recording element, and wherein a dot to be recorded in the pattern corresponding to the first recording element and a dot to be recorded in the pattern corresponding to the second recording element, at the same level, do not coincide with each other in position except in the pattern at the highest level n.

* * * * *

UNITED STATES PATENT AND TRADEMARK OFFICE

CERTIFICATE OF CORRECTION

PATENT NO. : 6,846,066 B2
DATED : January 25, 2005
INVENTOR(S) : Teshikawara et al.

It is certified that error appears in the above-identified patent and that said Letters Patent is hereby corrected as shown below:

Title page,
Item [12], United States Patent, "Teshikawara et al." should read
-- Teshigawara et al. --.
Item [75], Inventors, "Minoru Teshikawara," should read -- Minoru Teshigawara, --
and "Tetyuya Edamura," should read -- Tetsuya Edamura, --.

Column 5,
Line 33, "First Preferred Embodiment scan direction." should read
-- scan direction. --, and
-- First Preferred Embodiment -- should be a separate heading.

Signed and Sealed this

Sixteenth Day of August, 2005

JON W. DUDAS
*Director of the United States Patent and Trademark Office*